US011685879B2

(12) United States Patent
Musyimi

(10) Patent No.: US 11,685,879 B2
(45) Date of Patent: Jun. 27, 2023

(54) AZEOTROPIC COMPOSITIONS COMPRISING DIMETHYL CARBONATE AND PERFLUOROALKENE ETHERS

(71) Applicant: THE CHEMOURS COMPANY FC, LLC, Wilmington, DE (US)

(72) Inventor: Harrison K. Musyimi, Bear, DE (US)

(73) Assignee: THE CHEMOURS COMPANY FC, LLC, Wilmington, DE (US)

( * ) Notice: Subject to any disclaimer, the term of this patent is extended or adjusted under 35 U.S.C. 154(b) by 316 days.

(21) Appl. No.: 17/273,375

(22) PCT Filed: Sep. 11, 2019

(86) PCT No.: PCT/US2019/050289

§ 371 (c)(1),
(2) Date: Mar. 4, 2021

(87) PCT Pub. No.: WO2020/055782

PCT Pub. Date: Mar. 19, 2020

(65) Prior Publication Data

US 2021/0340468 A1 Nov. 4, 2021

Related U.S. Application Data

(60) Provisional application No. 62/729,800, filed on Sep. 11, 2018.

(51) Int. Cl.
*C11D 7/50* (2006.01)
*C11D 11/00* (2006.01)

(52) U.S. Cl.
CPC ..... *C11D 7/5086* (2013.01); *C11D 11/0047* (2013.01)

(58) Field of Classification Search
CPC ..... C11D 7/50
USPC ..... 510/409, 411, 506
See application file for complete search history.

(56) References Cited

U.S. PATENT DOCUMENTS

| | | | |
|---|---|---|---|
| 5,759,986 A | 6/1998 | Merchant et al. | |
| 2012/0024319 A1 | 2/2012 | Bartelt et al. | |
| 2021/0139441 A1* | 5/2021 | Petrov | H01B 3/24 |

FOREIGN PATENT DOCUMENTS

| | | |
|---|---|---|
| JP | 201743680 A | 3/2017 |
| WO | 9506693 | 3/1995 |
| WO | 2013040266 A1 | 3/2013 |
| WO | 2017216492 A1 | 12/2017 |

OTHER PUBLICATIONS

M. F. Doherty and M.F. Malone, Conceptual Design of Distillation Systems, McGraw-Hill (New York), 2001, 185.

* cited by examiner

*Primary Examiner* — Gregory E Webb

(57) ABSTRACT

The present application provides azeotrope or azeotrope-like compositions comprising dimethyl carbonate and a perfluoroheptene ether or a perfluoropentene ether, wherein the perfluoroheptene ether or perfluoropentene ether is present in the composition in an amount effective to form an azeotrope composition or azeotrope-like composition with the dimethyl carbonate. Methods of using the composition provided herein in cleaning and carrier fluid applications are also provided.

23 Claims, 4 Drawing Sheets

AZEOTROPIC COMPOSITIONS COMPRISING DIMETHYL CARBONATE AND PERFLUOROALKENE ETHERS

CROSS REFERENCE TO RELATED APPLICATIONS

This application is a national filing under 35 U.S. C. 371 of International Application No. PCT/US2019/050289 filed Sep. 10, 2019, and claims priority of U.S. Provisional Application No. 62/729,800, filed Sep. 11, 2018, the disclosures of which are incorporated herein by reference in its entirety.

TECHNICAL FIELD

This invention relates to azeotrope or azeotrope-like compositions comprising dimethyl carbonate and a perfluoroheptene ether or a perfluoropentene ether, wherein the perfluoroheptene ether or perfluoropentene ether is present in the composition in an amount effective to form an azeotrope composition or azeotrope-like composition with the dimethyl carbonate, which are useful in cleaning and carrier fluid applications.

BACKGROUND

Chlorofluorocarbon (CFC) compounds have been used extensively in the area of semiconductor manufacture to clean surfaces such as magnetic disk media. However, chlorine-containing compounds such as CFC compounds are considered to be detrimental to the Earth's ozone layer. In addition, many of the hydrofluorocarbons used to replace CFC compounds have been found to contribute to global warming. Therefore, there is a need to identify new environmentally safe solvents for cleaning applications, such as removing residual flux, lubricant or oil contaminants, and particles. There is also a need for identification of new solvents for deposition of fluorolubricants and for drying or dewatering of substrates that have been processed in aqueous solutions.

SUMMARY

The present application provides, inter alia, a composition comprising:

i) dimethyl carbonate; and ii) a compound selected from methoxy perfluoroheptene and methoxy perfluoropentene;

wherein the methoxy perfluoroheptene or methoxy perfluoropentene is present in the composition in an amount effective to form an azeotrope composition or azeotrope-like composition with the dimethyl carbonate.

The present application further provides a composition comprising HFC-4310mee and methyl acetate, wherein HFC-4310mee and methyl acetate are present in the composition in amounts effective to form an azeotrope composition or azeotrope-like composition.

The present application further provides processes for dissolving a solute, comprising contacting and mixing said solute with a sufficient quantity of the composition described herein.

The present application further provides a processes of cleaning a surface, comprising contacting a composition described herein with said surface.

The present application further provides a process for removing at least a portion of water from the surface of a wetted substrate, comprising contacting the substrate with the composition described herein, and then removing the substrate from contact with the composition.

Unless otherwise defined, all technical and scientific terms used herein have the same meaning as commonly understood by one of ordinary skill in the art to which this invention belongs. Methods and materials are described herein for use in the present invention; other, suitable methods and materials known in the art can also be used. The materials, methods, and examples are illustrative only and not intended to be limiting. All publications, patent applications, patents, sequences, database entries, and other references mentioned herein are incorporated by reference in their entirety. In case of conflict, the present specification, including definitions, will control.

DETAILED DESCRIPTION

Figure 1:
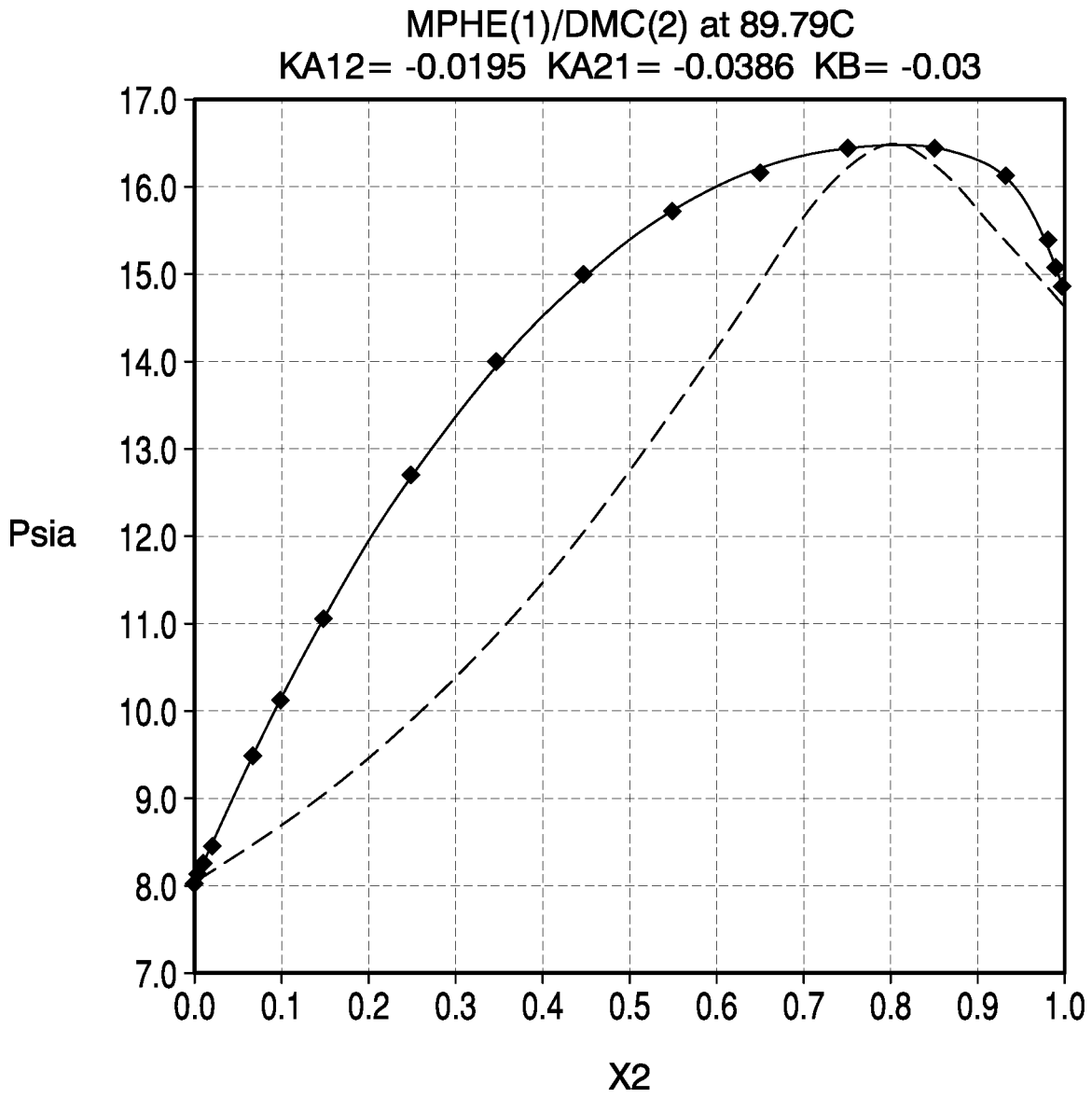
FIG. 1 shows a VLE plot representative of a binary blend of dimethyl carbonate and methoxy perfluoroheptene at 89.79° C.

The present disclosure provides new azeotropic and azeotrope-like compositions comprising hydrofluorocarbon mixtures. These compositions have utility in many of the applications formerly served by CFC compounds. The compositions of the present disclosure possess some or all of the desired properties of little or no environmental impact and the ability to dissolve oils, and/or greases or fluxes.

Definitions and Abbreviations

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

As used herein, the term "consisting essentially of" is used to define a composition, method that includes materials, steps, features, components, or elements, in addition to those literally disclosed provided that these additional included materials, steps, features, components, or elements do not materially affect the basic and novel characteristic(s) of the claimed invention, especially the mode of action to achieve the desired result of any of the processes of the present invention. The term "consists essentially of" or "consisting essentially of" occupies a middle ground between "comprising" and "consisting of".

Also, use of "a" or "an" are employed to describe elements and components described herein. This is done merely for convenience and to give a general sense of the scope of the invention. This description should be read to include one or at least one and the singular also includes the plural unless it is obvious that it is meant otherwise.

As used herein, the term "about" is meant to account for variations due to experimental error (e.g., plus or minus approximately 10% of the indicated value). All measurements reported herein are understood to be modified by the term "about", whether or not the term is explicitly used, unless explicitly stated otherwise.

When an amount, concentration, or other value or parameter is given as either a range, preferred range or a list of upper preferable values and/or lower preferable values, this is to be understood as specifically disclosing all ranges formed from any pair of any upper range limit or preferred value and any lower range limit or preferred value, regardless of whether ranges are separately disclosed. Where a range of numerical values is recited herein, unless otherwise stated, the range is intended to include the endpoints thereof, and all integers and fractions within the range.

As recognized in the art, an azeotropic composition is an admixture of two or more different components which, when in liquid form and (1a) under a given constant pressure, will boil at a substantially constant temperature, which temperature may be higher or lower than the boiling temperatures of the individual components, or (1b) at a given constant temperature, will boil at a substantially constant pressure, which pressure may be higher or lower than the boiling pressure of the individual components, and (2) will boil at substantially constant composition, which phase compositions, while constant, are not necessarily equal (see, e.g., M. F. Doherty and M. F. Malone, Conceptual Design of Distillation Systems, McGraw-Hill (New York), 2001, 185).

A homogeneous azeotrope, in which a single vapor phase is in equilibrium with a single liquid phase, has, in addition to properties (1a), (1b), and (2) above, the composition of each component is the same in each of the coexisting equilibrium phases. The general term "azeotrope" is a commonly used alternative name for a homogeneous azeotrope.

As used herein, an "azeotrope-like" composition refers to a composition that behaves like an azeotropic composition (i.e., has constant boiling characteristics or a tendency not to fractionate upon boiling or evaporation). Hence, during boiling or evaporation, the vapor and liquid compositions, if they change at all, change only to a minimal or negligible extent. In contrast, the vapor and liquid compositions of non-azeotrope-like compositions change to a substantial degree during boiling or evaporation.

As used herein, the terms "azeotrope-like" or "azeotrope-like behavior" refer to compositions that exhibit dew point pressure and bubble point pressure with virtually no pressure differential. In some embodiments, the difference in the dew point pressure and bubble point pressure at a given temperature is 3% or less. In some embodiments, the difference in the bubble point and dew point pressures is 5% or less.

Azeotrope and Azeotrope-Like Compositions

The present application provides a composition, comprising:

i) dimethyl carbonate; and ii) a compound selected from methoxy perfluoroheptene and methoxy perfluoropentene;

wherein the methoxy perfluoroheptene or methoxy perfluoropentene is present in the composition in an amount effective to form an azeotrope composition or azeotrope-like composition with the dimethyl carbonate.

In some embodiments, the composition comprises dimethyl carbonate and methoxy perfluoroheptene, wherein the methoxy perfluoroheptene is present in the composition in an amount effective to form an azeotrope composition or azeotrope-like composition with the dimethyl carbonate.

In some embodiments, the methoxy perfluoroheptene comprises a mixture of (E)-4-methoxy-perfluorohept-3-ene, (E)-3-methoxy-perfluorohept-3-ene, (E)-5-methoxy-perfluorohept-3-ene, (E)-4-methoxy-perfluorohept-2-ene, (Z)-3-methoxy-perfluorohept-3-ene, and (Z)-4-methoxy-perfluorohept-3-ene.

In some embodiments, the composition comprises from about 80 to about 5 weight percent dimethyl carbonate, for example, about 80 to about 10, about 80 to about 20, about 80 to about 30, about 80 to about 40, about 80 to about 50, about 80 to about 60, about 80 to about 70, about 70 to about 5, about 70 to about 10, about 70 to about 20, about 70 to about 30, about 70 to about 40, about 70 to about 50, about 70 to about 60, about 60 to about 5, about 60 to about 10, about 60 to about 20, about 60 to about 30, about 60 to about 40, about 60 to about 50, about 50 to about 5, about 50 to about 10, about 50 to about 20, about 50 to about 30, about 50 to about 40, about 40 to about 5, about 40 to about 10, about 40 to about 20, about 40 to about 30, about 30 to about 5, about 30 to about 10, about 30 to about 20, about 20 to about 5, about 20 to about 10, or about 10 to about 5 weight percent dimethyl carbonate weight percent dimethyl carbonate.

In some embodiments, the composition comprises from about 20 to about 95 weight percent methoxy perfluoroheptene, for example, about 20 to about 90, about 20 to about 80, about 20 to about 70, about 20 to about 60, about 20 to about 50, about 20 to about 40, about 20 to about 30, about 30 to about 95, about 30 to about 90, about 30 to about 80, about 30 to about 70, about 30 to about 60, about 30 to about 50, about 30 to about 40, about 40 to about 95, about 40 to about 90, about 40 to about 80, about 40 to about 70, about 40 to about 60, about 40 to about 50, about 50 to about 95, about 50 to about 90, about 50 to about 80, about 50 to about 70, about 50 to about 60, about 60 to about 95, about 60 to about 90, about 60 to about 80, about 60 to about 70, about 70 to about 95, about 70 to about 90, about 70 to about 80, about 80 to about 95, about 80 to about 90, or about 90 to about 95 weight percent methoxy perfluoroheptene.

In some embodiments, the composition consists essentially of dimethyl carbonate and methoxy perfluoroheptene.

In some embodiments, wherein the composition consists essentially of from about 80 to about 5 weight percent dimethyl carbonate as described above, and from about 20 to about 95 weight percent methoxy perfluoroheptene, as described above.

In some embodiments, wherein the composition consists essentially of from about 80 to about 40 weight percent dimethyl carbonate as described above, and from about 20 to about 60 weight percent methoxy perfluoroheptene, as described above.

In some embodiments, the composition consists essentially of about 49 to about 51 weight percent dimethyl carbonate and about 49 to about 51 weight percent methoxy perfluoroheptene.

In some embodiments, the composition consists essentially of about 50 weight percent dimethyl carbonate and about 50 weight percent methoxy perfluoroheptene.

In some embodiments, wherein the composition consists essentially of from about 5 to about 15 weight percent dimethyl carbonate as described above, and from about 85 to about 95 weight percent methoxy perfluoroheptene, as described above.

In some embodiments, wherein the composition consists essentially of from about 5 to about 10 weight percent dimethyl carbonate as described above, and from about 90 to about 95 weight percent methoxy perfluoroheptene, as described above.

In some embodiments, the composition consists essentially of about 8 to about 10 weight percent dimethyl carbonate and about 90 to about 92 weight percent methoxy perfluoroheptene.

In some embodiments, the composition consists essentially of about 9 weight percent dimethyl carbonate and about 91 weight percent methoxy perfluoroheptene.

In some embodiments, the composition comprising, consisting essentially of, or consisting of dimethyl carbonate and methoxy perfluoroheptene is an azeotrope composition.

In some embodiments, the composition comprising, consisting essentially of, or consisting of dimethyl carbonate and methoxy perfluoroheptene is an azeotrope-like composition.

In some embodiments, the composition comprising, consisting essentially of, or consisting of dimethyl carbonate and methoxy perfluoroheptene has a boiling point of about 85° C. to about 86° C. at a pressure of about 101 kPa.

In some embodiments, the composition comprising dimethyl carbonate and methoxy perfluoroheptene further comprises 1,1,2,2,3,3,4-heptafluorocyclopentane, wherein the methoxy perfluoroheptene and 1,1,2,2,3,3,4-heptafluorocyclopentane are each present in the composition in amounts effective to form an azeotrope composition or azeotrope-like composition with the dimethyl carbonate In some embodiments, the composition comprises from about 22 to about 35 weight percent dimethyl carbonate, for example, about 22 to about 30, about 22 to about 25, about 25 to about 35, about 25 to about 30, or about 30 to about 35 weight percent dimethyl carbonate.

In some embodiments, the composition comprises from about 20 to about 55 weight percent methoxy perfluoroheptene, for example, about 20 to about 50, about 20 to about 40, about 20 to about 30, about 30 to about 55, about 30 to about 50, about 30 to about 40, about 40 to about 55, about 40 to about 50, or about 50 to about 55 weight percent methoxy perfluoroheptene.

In some embodiments, the composition comprises from about 22 to about 35 weight percent methoxy perfluoroheptene, for example, about 22 to about 30, about 22 to about 25, about 25 to about 35, about 25 to about 30, or about 30 to about 35 weight percent methoxy perfluoroheptene.

In some embodiments, the composition comprises from about 30 to about 52 weight percent 1,1,2,2,3,3,4-heptafluorocyclopentane, for example, about 30 to about 45, about 30 to about 40, about 30 to about 35, about 35 to about 52, about 35 to about 45, about 35 to about 40, about 40 to about 52, about 40 to about 45, or about 45 to about 52 weight percent 1,1,2,2,3,3,4-heptafluorocyclopentane.

In some embodiments, the composition consists essentially of dimethyl carbonate, methoxy perfluoroheptene, and methoxy perfluoroheptene.

In some embodiments, the composition consists essentially of from about 22 to about 35 weight percent dimethyl carbonate as described above, from about 20 to about 55 weight percent methoxy perfluoroheptene as described above, and from about 30 to about 52 weight percent methoxy perfluoroheptene as described above.

In some embodiments, the composition consists essentially of from about 22 to about 35 weight percent dimethyl carbonate as described above, from about 22 to about 35 weight percent methoxy perfluoroheptene as described above, and from about 30 to about 52 weight percent methoxy perfluoroheptene as described above.

In some embodiments, the composition consists essentially of about 35 to about 45 weight percent 1,1,2,2,3,3,4-heptafluorocyclopentane, about 25 to about 35 weight percent dimethyl carbonate, and about 45 to about 55 weight percent methoxy perfluoroheptene.

In some embodiments, the composition consists essentially of about 39 to about 41 weight percent 1,1,2,2,3,3,4-heptafluorocyclopentane, about 29 to about 31 weight percent dimethyl carbonate, and about 29 to about 31 weight percent methoxy perfluoroheptene.

In some embodiments, the composition consists essentially of about 39 to about 41 weight percent 1,1,2,2,3,3,4-heptafluorocyclopentane, about 29 to about 31 weight percent dimethyl carbonate, and about 49 to about 51 weight percent methoxy perfluoroheptene.

In some embodiments, the composition consists essentially of about 40 weight percent 1,1,2,2,3,3,4-heptafluorocyclopentane, about 30 weight percent dimethyl carbonate, and about 30 weight percent methoxy perfluoroheptene.

In some embodiments, the composition consists essentially of about 40 weight percent 1,1,2,2,3,3,4-heptafluorocyclopentane, about 30 weight percent dimethyl carbonate, and about 50 weight percent methoxy perfluoroheptene.

In some embodiments, the composition comprising, consisting essentially of, or consisting of 1,1,2,2,3,3,4-heptafluorocyclopentane, dimethyl carbonate, and methoxy perfluoroheptene is an azeotrope composition.

In some embodiments, the composition comprising, consisting essentially of, or consisting of 1,1,2,2,3,3,4-heptafluorocyclopentane, dimethyl carbonate, and methoxy perfluoroheptene is an azeotrope-like composition.

In some embodiments, the composition comprising, consisting essentially of, or consisting of 1,1,2,2,3,3,4-heptafluorocyclopentane, dimethyl carbonate, and methoxy perfluoroheptene has a boiling point of about 88° C. at a pressure of about 101 kPa.

In some embodiments, the composition provided herein comprises dimethyl carbonate and methoxy perfluoropentene, wherein the methoxy perfluoropentene is present in the composition in an amount effective to form an azeotrope composition or azeotrope-like composition with the dimethyl carbonate.

In some embodiments, the methoxy perfluoropentene comprises a mixture of (E)-2-methoxy-perfluoropent-2-ene, (E)-4-methoxy-perfluoropent-2-ene, (Z)-2-methoxy-perfluoropent-2-ene, (Z)-4-methoxy-perfluoropent-2-ene, (E)-3-methoxy-perfluoropent-2-ene, and (Z)-3-methoxy-perfluoropent-2-ene.

In some embodiments, the composition comprises from about 0.1 to about 12 weight percent dimethyl carbonate, for example, about 0.1 to about 10, about 0.1 to about 5, about 0.1 to about 3, about 0.1 to about 1, about 1 to about 12, about 1 to about 10, about 1 to about 5, about 1 to about 3, about 3 to about 12, about 3 to about 10, about 3 to about 5, about 5 to about 12, or about 10 to about 12 weight percent dimethyl carbonate.

In some embodiments, the composition comprises from about 99.9 to about 88 weight percent methoxy perfluoropentene, for example, about 99.9 to about 90, about 99.9 to about 95, about 99.9 to about 97, about 99.9 to about 99, about 99 to about 88, about 99 to about 90, about 99 to about 95, about 99 to about 97, about 97 to about 88, about 97 to about 90, about 97 to about 95, about 95 to about 88, about 95 to about 90, or about 90 to about 88 weight percent methoxy perfluoropentene In some embodiments, the composition consists essentially of dimethyl carbonate and methoxy perfluoropentene.

In some embodiments, the composition consists essentially of from about from about 0.1 to about 12 weight percent dimethyl carbonate as described above, and from about 99.9 to about 88 weight percent methoxy perfluoropentene as described above.

In some embodiments, the composition consists essentially of about 7 to about 9 weight percent dimethyl carbonate and about 91 to about 93 weight percent methoxy perfluoropentene.

In some embodiments, the composition consists essentially of about 8 weight percent dimethyl carbonate and about 92 weight percent methoxy perfluoropentene.

In some embodiments, the composition comprising, consisting essentially of, or consisting of dimethyl carbonate and methoxy perfluoropentene is an azeotrope composition.

In some embodiments, the composition comprising, consisting essentially of, or consisting of dimethyl carbonate and methoxy perfluoropentene is an azeotrope-like composition.

In some embodiments, the composition comprising, consisting essentially of, or consisting of dimethyl carbonate and methoxy perfluoropentene has a boiling point of about 74° C. at a pressure of about 101 kPa.

In some embodiments, the present application further provides a composition comprising HFC-4310mee and methyl acetate, wherein HFC-4310mee and methyl acetate are present in the composition in amounts effective to form an azeotrope composition or azeotrope-like composition.

In some embodiments, the composition comprises about 15 to about 30 weight percent methyl acetate, for example, about 15 to about 25, about 15 to about 20, about 20 to about 30, about 20 to about 25, or about 25 to about 30 weight percent methyl acetate.

In some embodiments, the composition comprises about 70 to about 85 weight percent HFC-4310mee, for example, about 70 to about 80, about 70 to about 75, about 75 to about 85, about 75 to about 80, or about 80 to about 85 weight percent HFC-4310-mee.

In some embodiments, the composition consists essentially of HFC-4310mee and methyl acetate.

In some embodiments, the composition consists essentially of about 15 to about 30 weight percent methyl acetate as described above and about 70 to about 85 weight percent HFC-4310mee as described above.

In some embodiments, the composition consists essentially of about 24 to about 26 weight percent methyl acetate and about 74 to about 76 weight percent HFC-4310mee.

In some embodiments, the composition consists essentially of about 25 weight percent methyl acetate and about 75 weight percent HFC-4310mee.

In some embodiments, the composition comprising, consisting essentially of, or consisting of HFC-4310mee and methyl acetate is an azeotrope composition.

In some embodiments, the composition comprising, consisting essentially of, or consisting of HFC-4310mee and methyl acetate is an azeotrope-like composition.

In some embodiments, the composition comprising, consisting essentially of, or consisting of HFC-4310mee and methyl acetate has a boiling of about 59° C. to about 60° C. at a pressure of about 101 kPa.

Methods of Use

In some embodiments, compositions described herein are useful as cleaning agents, defluxing agents, and/or degreasing agents. Accordingly, the present application provides a process of cleaning a surface, comprising contacting a composition provided herein with said surface. In some embodiments, the process comprises removing a residue from a surface or substrate, comprising contacting the surface or substrate with a composition provided herein and recovering the surface or substrate from the composition.

In some embodiments, the present application further provides a process for dissolving a solute, comprising contacting and mixing said solute with a sufficient quantity of a composition provided herein.

In some embodiments, the surface or substrate may be an integrated circuit device, in which case, the residue comprises rosin flux or oil. The integrated circuit device may be a circuit board with various types of components, such as Flip chips, μBGAs, or Chip scale packaging components. The surface or substrate may additionally be a metal surface such as stainless steel. The rosin flux may be any type commonly used in the soldering of integrated circuit devices, including but not limited to RMA (rosin mildly activated), RA (rosin activated), WS (water soluble), and OA (organic acid). Oil residues include but are not limited to mineral oils, motor oils, and silicone oils.

In some embodiments, the present application provides a process for removing at least a portion of water from the surface of a wetted substrate, or surface, or device, comprising contacting the substrate, surface, or device with a composition provided herein, and then removing the substrate, surface, or device from contact with the composition.

In some embodiments, the composition provided herein further comprises at least one surfactant suitable for dewatering or drying the substrate. Exemplary surfactants include, but are not limited to, alkyl dimethyl ammonium isooctyl phosphates, tert-alkyl amines (e.g., tert-butyl amine), perfluoro alkyl phosphates, dimethyl decenamide, fluorinated alkyl polyether, quaternary amines (e.g., ammonium salts), and glycerol monostearate.

The means for contacting a device, surface, or substrate is not critical and may be accomplished, for example, by immersion of the device, surface, or substrate, in a bath containing the composition provided herein, spraying the device, surface, or substrate with the composition provided herein, or wiping the device, surface, or substrate with a material (e.g., a cloth) that has been wet with the composition. Alternatively, a composition provided herein may also be used in a vapor degreasing or defluxing apparatus designed for such residue removal. Such vapor degreasing or defluxing equipment is available from various suppliers such as Forward Technology (a subsidiary of the Crest Group, Trenton, N.J.), Trek Industries (Azusa, Calif.), and Ultronix, Inc. (Hatfield, Pa.) among others.

EXAMPLES

The invention will be described in greater detail by way of specific examples. The following examples are offered for illustrative purposes, and are not intended to limit the invention in any manner. Those of skill in the art will readily recognize a variety of non-critical parameters which can be changed or modified to yield essentially the same results.

Example 1. Vapor-Liquid Equilibrium Analysis and Distillation Analysis

Vapor-Liquid Equilibrium Analysis

The PTx method is a known method for experimentally measuring vapor-liquid phase equilibrium (VLE) data of a mixture. The measurements can be made either isothermally or isobarically. The isothermal method requires measurement of the total pressure of mixtures of known composition at constant temperature. In this method, the total absolute pressure in a cell of known volume is measured at a constant temperature for various known compositions of the two compounds. The isobaric method requires measurement of the temperature of mixtures of known composition at constant pressure. In this method, the temperature in a cell of known volume is measured at a constant pressure for various known compositions of the two compounds. Use of the PTx Method is described in detail in "Phase Equilibrium in Process Design", Wiley-Interscience Publisher, 1970, written by Harold R. Null, on pages 124 to 126, the disclosure of which is incorporated herein by reference in its entirety.

The measured data points can be converted into equilibrium vapor and liquid compositions in the PTx cell by using an activity coefficient equation model, such as the Non-Random, Two-Liquid (NRTL) equation, to represent liquid phase nonidealities. Use of an activity coefficient equation, such as the NRTL equation is described in detail in "The Properties of Gases and Liquids," 4th edition, published by McGraw Hill, written by Reid, Prausnitz and Poling, on pages 241 to 387, and in "Phase Equilibria in Chemical Engineering," published by Butterworth Publishers, 1985, written by Stanley M. Walas, pages 165 to 244, the disclosure of which is incorporated herein by reference in its entirety. Without wishing to be bound by any theory or explanation, it is believed that the NRTL equation, together with the PTx cell data, sufficiently predicts the vapor-liquid phase equilibrium behavior of the various mixture compositions of the present invention and as well as the behavior of these mixtures in multi-stage separation equipment such as distillation columns.

Distillation Analysis

Mixtures were prepared and distilled in a 25-plate distillation column at a pressure of 760 mm Hg per standard ASTM method D 1078. Head and flask temperatures were monitored directly to 1° C. Distillate samples were taken throughout the distillation for determination of composition by gas chromatography.

Azeotrope Compositions

Table 1 shows the azeotrope range and azeotrope point determined by distillation and/or VLE analysis for various binary and ternary compositions of dimethyl carbonate and a binary composition of HFC-4310mee and methyl acetate at atmospheric pressure (approximately 101 kPa). MPHE=methoxy perfluoroheptene ether (i.e., methoxy perfluoroheptene); MPPE=methoxy perfluoropentene ether (i.e., methoxy perfluoropentene); DMC=dimethyl carbonate; HFCP=1,1,2,2,3,3,4-heptafluoroc ylopentane. MeOAc=methyl acetate.

TABLE 1

| Composition | Boiling Point (° C.) | Azeotrope Range (wt %) | Azeotrope Point (wt %) |
|---|---|---|---|
| MPHE & DMC | 85-86 | 20% to 60% MPHE | 50% MPHE<br>50% DMC |
| MPPE & DMC | 74.3 | 0% to 12% DMC | 92% MPPE<br>8% DMC |
| MPHE, DMC, & HFCP | 88 | 22% to 35% DMC and MPHE<br>30% to 52% HFCP | 40% HFCP<br>30% DMC<br>30% MPHE |
| HFC-4310mee & MeOAc | 59.4 | 15% to 30% MeOAc | 25% MeOAc<br>75% HFC-4310mee |

Figure 2:
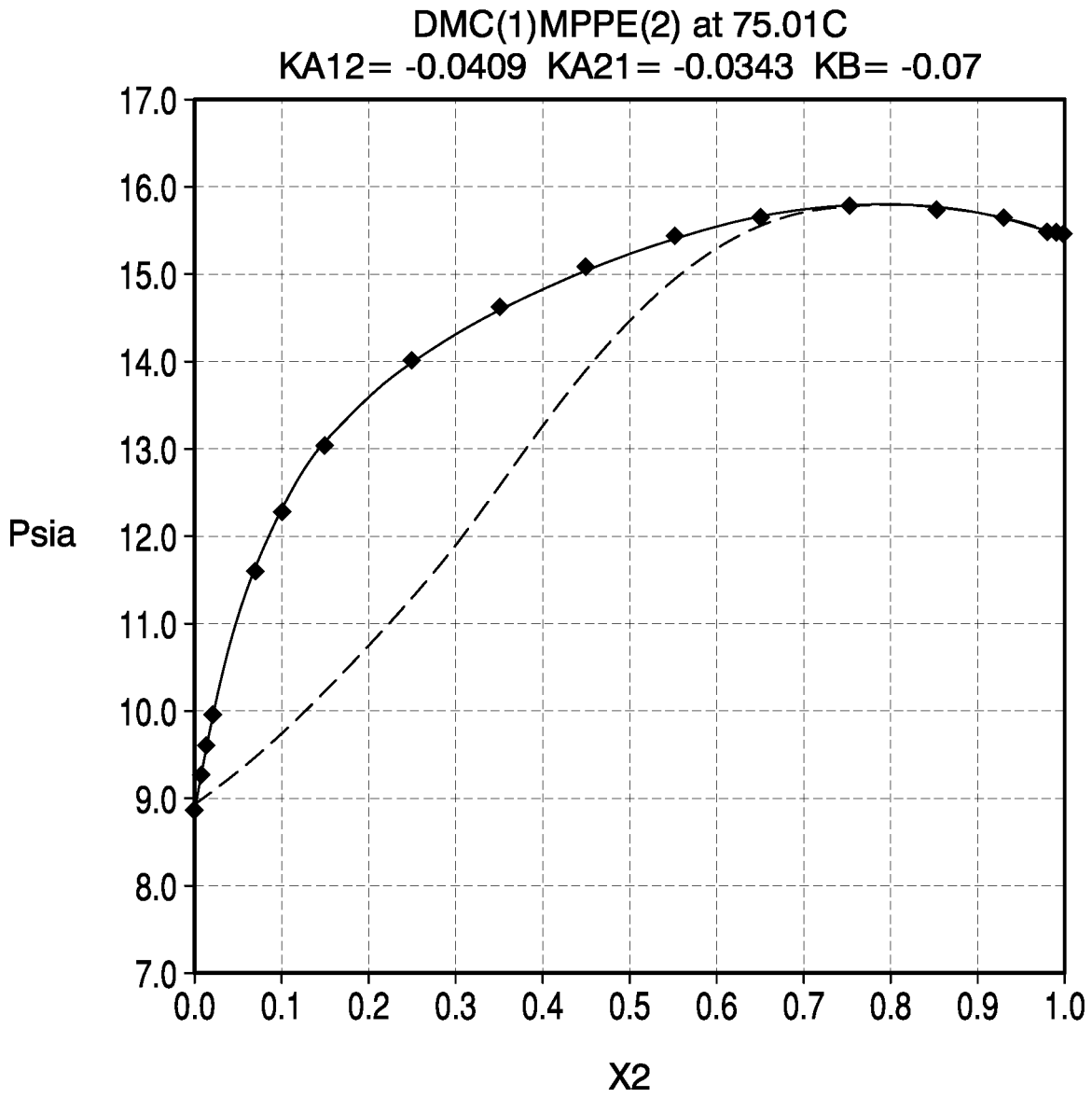
FIG. 2 shows a VLE plot representative of a binary blend of dimethyl carbonate and methoxy perfluoropentene 75.01° C.

FIGS. 1-2 show VLE data for compositions of (A) a binary blend of dimethyl carbonate and methoxy perfluoroheptene ether (FIG. 1) and (B) a binary blend of dimethyl carbonate and methoxy perfluoropentene ether (FIG. 2). The tabulated VLE data corresponding to FIG. 1 is shown below in Table 2, and the tabulated VLE data corresponding to FIG. 2 is shown below in Table 3.

TABLE 2

| | | Vapor-Phase Composition (mole fraction) | |
|---|---|---|---|
| Azeotropic Temperature (° C.) | Azeotropic Pressure (psia) | Dimethyl carbonate | Methoxy perfluoroheptene ether |
| 25 | 1.08 | 0.82 | 0.18 |
| 30 | 1.40 | 0.82 | 0.18 |
| 35 | 1.79 | 0.82 | 0.18 |
| 40 | 2.26 | 0.81 | 0.19 |
| 45 | 2.84 | 0.81 | 0.19 |
| 50 | 3.53 | 0.81 | 0.19 |
| 55 | 4.36 | 0.80 | 0.20 |
| 60 | 5.34 | 0.80 | 0.20 |
| 65 | 6.50 | 0.80 | 0.20 |
| 70 | 7.86 | 0.79 | 0.21 |
| 75 | 9.44 | 0.79 | 0.21 |
| 80 | 11.27 | 0.79 | 0.21 |
| 85 | 13.37 | 0.78 | 0.22 |
| 90 | 15.79 | 0.78 | 0.22 |
| 95 | 18.54 | 0.78 | 0.22 |
| 100 | 21.67 | 0.77 | 0.23 |
| 105 | 25.21 | 0.77 | 0.23 |

TABLE 3

| | | Vapor-Phase Composition (mole fraction) | |
|---|---|---|---|
| Azeotropic Temperature (° C.) | Azeotropic Pressure (psia) | Dimethyl carbonate | Methoxy perfluoropentene ether |
| 25 | 2.22 | 0.16 | 0.84 |
| 30 | 2.81 | 0.17 | 0.83 |
| 35 | 3.53 | 0.17 | 0.83 |
| 40 | 4.39 | 0.17 | 0.83 |
| 45 | 5.42 | 0.17 | 0.83 |
| 50 | 6.63 | 0.18 | 0.82 |
| 55 | 8.06 | 0.18 | 0.82 |
| 60 | 9.72 | 0.18 | 0.82 |
| 65 | 11.66 | 0.19 | 0.81 |
| 70 | 13.89 | 0.19 | 0.81 |
| 75 | 16.45 | 0.20 | 0.80 |
| 80 | 19.38 | 0.20 | 0.80 |
| 85 | 22.71 | 0.20 | 0.80 |
| 90 | 26.48 | 0.21 | 0.79 |

TABLE 3-continued

| Azeotropic Temperature (° C.) | Azeotropic Pressure (psia) | Vapor-Phase Composition (mole fraction) | |
|---|---|---|---|
| | | Dimethyl carbonate | Methoxy perfluoropentene ether |
| 95 | 30.73 | 0.21 | 0.79 |
| 100 | 35.49 | 0.21 | 0.79 |
| 105 | 40.83 | 0.22 | 0.78 |

Figure 3:
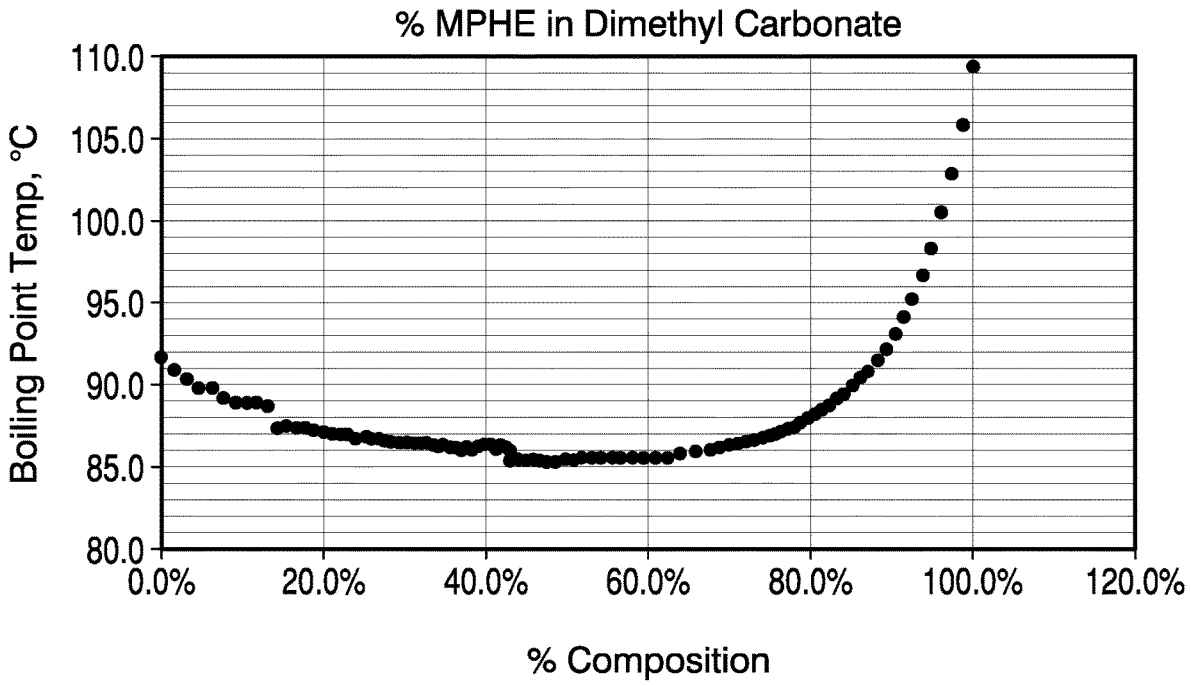
FIG. 3 shows the azeotrope-like behavior of binary blends of dimethyl carbonate and methoxy perfluoroheptene.

As shown in FIG. 3, a binary mixture containing dimethyl carbonate and 40% to 60% methoxy perfluoroheptene ether exhibited a constant boiling temperature, characteristic of azeotrope-like behavior. The tabulated data are shown below in Table 4.

TABLE 4

| % MPHE | B.P ° C. |
|---|---|
| 0.0% | 91.6 |
| 1.6% | 90.8 |
| 3.2% | 90.3 |
| 4.8% | 89.8 |
| 6.3% | 89.8 |
| 7.7% | 89.2 |
| 9.1% | 88.9 |
| 10.5% | 88.9 |
| 11.8% | 88.9 |
| 13.1% | 88.7 |
| 14.4% | 87.4 |
| 15.6% | 87.5 |
| 16.7% | 87.3 |
| 17.9% | 87.3 |
| 19.0% | 87.2 |
| 20.1% | 87.1 |
| 21.1% | 87.0 |
| 22.2% | 87.0 |
| 23.2% | 86.9 |
| 24.1% | 86.7 |
| 25.1% | 86.8 |
| 26.0% | 86.7 |
| 26.9% | 86.7 |
| 27.8% | 86.6 |
| 28.7% | 86.5 |
| 29.5% | 86.4 |
| 30.3% | 86.5 |
| 31.1% | 86.5 |
| 31.9% | 86.4 |
| 32.7% | 86.5 |
| 33.5% | 86.3 |
| 34.2% | 86.2 |
| 34.9% | 86.3 |
| 35.6% | 86.2 |
| 36.3% | 86.2 |
| 37.0% | 86.1 |
| 37.6% | 86.2 |
| 38.3% | 86.1 |
| 38.9% | 86.2 |
| 39.5% | 86.3 |
| 40.1% | 86.3 |
| 40.7% | 86.3 |
| 41.3% | 86.1 |
| 41.9% | 86.3 |
| 42.4% | 86.2 |
| 43.0% | 86.1 |
| 100.0% | 109.3 |

Figure 4:
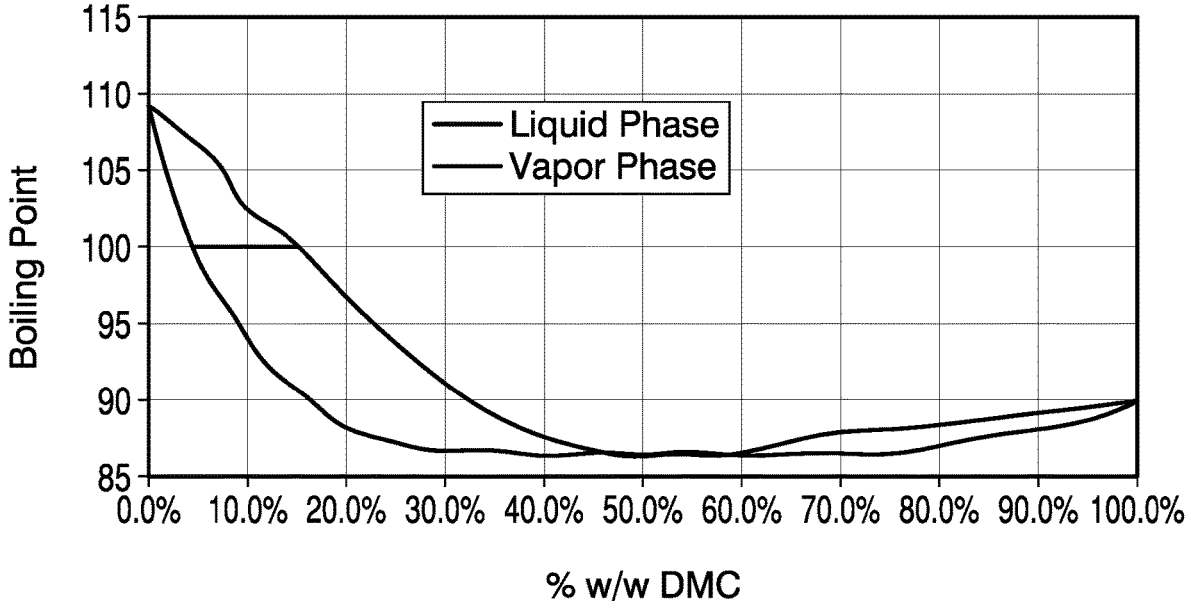
FIG. 4 shows a temperature-composition diagram of binary blends of dimethyl carbonate and methoxy perfluoroheptene exhibiting azeotrope behavior.

Vapor and liquid phase for blends containing 45% to 60% methoxy perfluoroheptene ether and dimethyl carbonate were also found to exhibit identical compositions, characteristic of azeotrope behavior, as shown in FIG. 4. The tabulated data are shown below in Table 5.

TABLE 5

| % DMC | BP (° C.) | DMC VP |
|---|---|---|
| 100.0% | 109.2 | 0.0% |
| 93.5% | 105.8 | 6.5% |
| 90.4% | 102.7 | 9.6% |
| 85.8% | 100.6 | 14.2% |
| 79.9% | 96.8 | 20.1% |
| 73.4% | 92.9 | 26.6% |
| 64.4% | 88.8 | 35.6% |
| 55.6% | 86.8 | 44.4% |
| 52.7% | 86.6 | 47.3% |
| 50.3% | 86.5 | 49.7% |
| 49.0% | 86.4 | 51.0% |
| 46.6% | 86.5 | 53.4% |
| 41.2% | 86.5 | 58.8% |
| 33.0% | 87.6 | 67.0% |
| 18.4% | 88.6 | 81.6% |
| 0.0% | 89.9 | 100.0% |

Example 2. Flammability and Flash Point Testing

Flash point testing was performed using a mixture of IFC-4310mee and methyl acetate. The flash point was determined using ASTM D56-05(2010), the standard test method for flash point by Tag closed Cup Tester. As shown in Table 6, mixtures denoted as "NF" were determined to be non-flammable.

TABLE 6

| % HFC-4310mee | % dimethyl carbonate | Flash Point (° C.) |
|---|---|---|
| 75.1 | 24.9 | −8 |
| 77.0 | 23.0 | −7.8 |
| 79.9 | 20.1 | NF |
| 82.0 | 18.0 | NF |
| 86.1 | 13.9 | NF |

Example 3. Cleaning Effectiveness of 50% Dimethyl Carbonate/50% Methoxy Perfluoroheptene Blend A of mixture 50% dimethyl carbonate and 50% methoxy perfluoroheptene was decanted into a 1000 mL beaker with a condensing coil and heated to the boiling point (85.4° C.) using a hot plate. Three pre-cleaned 304 stainless steel coupons were weighed on an analytical balance. A thin film of Mobil 600 W cylinder oil was applied to one surface of each coupon and excess was removed with a wipe. Each coupon was then re-weighed to determine the oiled weight and amount of oil deposited. The coupons were then placed in the vapor phase of the boiling solvent blend for ten minutes. Coupons were then removed and allowed to dry and off-gas for ten minutes before reweighing to determine the cleaning effectiveness factor of the solvent blend. The cleaning effectiveness factor (CEF) was determined by Equation 1. Results of the cleaning analysis are shown in Table 7.

TABLE 7

Equation 1.
CEF = (soiled weight − post cleaned weight)/(soiled weight − initial weight)

| Coupon ID | Initial Weight (g) | Oiled Weight (g) | Post-Cleaning Weight (g) | CEF (%) |
|---|---|---|---|---|
| 36 | 58.0013 | 58.0062 | 58.0013 | 100.0 |
| 26 | 58.6605 | 58.6727 | 58.6603 | 101.6 |
| 47 | 58.1894 | 58.1976 | 58.1893 | 101.2 |

Example 4. Cleaning Effectiveness of 30% Dimethyl Carbonate/50% Methoxy Perfluoroheptene/40% 1,1,2,2,3,3,4-Heptafluorocyclopentane Blend A mixture of 30% dimethyl carbonate/50% methoxy perfluoroheptene/40% 1,1,2,2,3,3,4-heptafluorocyclopentane was decanted into a 1000 mL beaker with a condensing coil and heated to the boiling point (88° C.) using a hot plate. Three pre-cleaned 304 stainless steel coupons were weighed on an analytical balance. A thin film of Chesterton AWC cutting oil was applied to one surface of each coupon and excess was removed with a wipe. Each coupon was then re-weighed to determine the oiled weight and amount of oil deposited. The coupons were then placed in the vapor phase of the boiling solvent blend for ten minutes. Coupons were then removed and allowed to dry and off-gas for ten minutes before re-weighing to determine the cleaning effectiveness factor of the solvent blend. The cleaning effectiveness factor (CEF) was determined by Equation 1. Results of the cleaning analysis are shown in Table 8.

TABLE 8

| Coupon ID | Initial Weight (g) | Oiled Weight (g) | Post-Cleaning Weight (g) | CEF (%) |
|---|---|---|---|---|
| 36 | 58.0016 | 58.0256 | 58.0019 | 98.8 |
| 26 | 58.6602 | 58.6938 | 58.6605 | 99.1 |
| 47 | 58.1892 | 58.2154 | 58.1895 | 98.9 |

Example 5. Cleaning Effectiveness of 9% Dimethyl Carbonate/91% Methoxy Perfluoroheptene Blend A mixture of 9% dimethyl carbonate/91% methoxy perfluoroheptene was decanted into a 1000 mL beaker with a condensing coil and heated to the boiling point (74.3° C.) using a hot plate. Three pre-cleaned 304 stainless steel coupons were weighed on an analytical balance. The coupons were heated with a hot air gun and wiped with holding wax block to deposit a thin film of wax. Each coupon was then re-weighed to determine the wax weight. Then placed in the vapor phase of the boiling solvent blend for ten minutes. Coupons were then removed and allowed to dry and off-gas for ten minutes before re-weighing to determine the cleaning effectiveness factor of the solvent blend. The cleaning effectiveness factor (CEF) was determined by Equation 1. Results of the cleaning analysis are shown in Table 9.

TABLE 9

| Coupon ID | Initial Weight (g) | Oiled Weight (g) | Post-Cleaning Weight (g) | CEF (%) |
|---|---|---|---|---|
| 28 | 58.3502 | 58.3823 | 58.3499 | 100.9 |
| 30 | 58.61 | 58.6447 | 58.6149 | 85.9 |
| 50 | 57.835 | 57.8566 | 57.8375 | 88.4 |

Other Embodiments

1. In some embodiments, the present application provides a composition, comprising:

i) dimethyl carbonate; and ii) a compound selected from methoxy perfluoroheptene and methoxy perfluoropentene;

wherein the methoxy perfluoroheptene or methoxy perfluoropentene is present in the composition in an amount effective to form an azeotrope composition or azeotrope-like composition with the dimethyl carbonate.

2. The composition of embodiment 1, wherein the composition comprises dimethyl carbonate and methoxy perfluoroheptene, wherein the methoxy perfluoroheptene is present in the composition in an amount effective to form an azeotrope composition or azeotrope-like composition with the dimethyl carbonate.

3. The composition of embodiment 1 or 2, wherein the methoxy perfluoroheptene comprises a mixture of (E)-4-methoxy-perfluorohept-3-ene, (E)-3-methoxy-perfluorohept-3-ene, (E)-5-methoxy-perfluorohept-3-ene, (E)-4-methoxy-perfluorohept-2-ene, (Z)-3-methoxy-perfluorohept-3-ene, and (Z)-4-methoxy-perfluorohept-3-ene.

4. The composition of any one of embodiments 1 to 3, wherein the composition comprises from about 80 to about 40 weight percent dimethyl carbonate.

5. The composition of any one of embodiments 1 to 4, wherein the composition comprises from about 20 to about 60 weight percent methoxy perfluoroheptene.

6. The composition of any one of embodiments 1 to 5, wherein the composition consists essentially of dimethyl carbonate and methoxy perfluoroheptene.

7. The composition of any one of embodiments 1 to 3 and 5, wherein the composition consists essentially of from about from about 80 to about 40 weight percent dimethyl carbonate and from about 20 to about 60 weight percent methoxy perfluoroheptene.

8. The composition of any one of embodiments 1 to 3 and 5, wherein the composition consists essentially of about 50 weight percent dimethyl carbonate and about 50 weight percent methoxy perfluoroheptene.

9. The composition of any one of embodiments 1 to 8, wherein the composition is an azeotrope composition.

10. The composition of any one of embodiments 1 to 9, wherein the composition has a boiling point of about 85° C. to about 86° C. at a pressure of about 101 kPa.

11. The composition of any one of embodiments 2 to 10, further comprising 1,1,2,2,3,3,4-heptafluorocyclopentane, wherein the methoxy perfluoroheptene and 1,1,2,2,3,3,4-heptafluorocyclopentane are each present in the composition in amounts effective to form an azeotrope composition or azeotrope-like composition with the dimethyl carbonate 12. The composition of embodiment 11, wherein the composition comprises from about 22 to about 35 weight percent dimethyl carbonate.

13. The composition of embodiment 11 or 12, wherein the composition comprises from about 22 to about 35 weight percent methoxy perfluoroheptene.

14. The composition of any one of embodiments 11 to 13, wherein the composition comprises from about 30 to about 52 weight percent 1,1,2,2,3,3,4-heptafluorocyclopentane.

15. The composition of any one of embodiments 11 to 14, wherein the composition consists essentially of dimethyl carbonate, methoxy perfluoroheptene, and methoxy perfluoroheptene.

16. The composition of embodiment 11, wherein the composition consists essentially of from about 22 to about 35 weight percent dimethyl carbonate, from about 22 to about 35 weight percent methoxy perfluoroheptene, and from about 30 to about 52 weight percent methoxy perfluoroheptene.

17. The composition of embodiment 11, wherein the composition consists essentially of about 40 weight percent 1,1,2,2,3,3,4-heptafluorocyclopentane, about weight percent dimethyl carbonate, and about 30 weight percent methoxy perfluoroheptene.

18. The composition of any one of embodiments 11 to 17, wherein the composition is an azeotrope composition.

19. The composition of any one of embodiments 11 to 18, wherein the composition has a boiling point of about 88° C. at a pressure of about 101 kPa.

20. The composition of embodiment 1, wherein the composition comprises dimethyl carbonate and methoxy perfluoropentene, wherein the methoxy perfluoropentene is present in the composition in an amount effective to form an azeotrope composition or azeotrope-like composition with the dimethyl carbonate.

21. The composition of embodiment 1 to 20, wherein the methoxy perfluoropentene comprises a mixture of (E)-2-methoxy-perfluoropent-2-ene, (E)-4-methoxy-perfluoropent-2-ene, (Z)-2-methoxy-perfluoropent-2-ene, (Z)-4-methoxy-perfluoropent-2-ene, (E)-3-methoxy-perfluoropent-2-ene, and (Z)-3-methoxy-perfluoropent-2-ene.

22. The composition of any one of embodiments 1, 20 and 21, wherein the composition comprises from about 0.1 to about 12 weight percent dimethyl carbonate.

23. The composition of any one of embodiments 1 and 20 to 22, wherein the composition comprises from about 99.9 to about 88 weight percent methoxy perfluoropentene.

24. The composition of any one of embodiments 1, 20, and 21, wherein the composition consists essentially of dimethyl carbonate and methoxy perfluoropentene.

25. The composition of any one of embodiments 1, 20, 21, and 24, wherein the composition consists essentially of from about from about 0.1 to about 12 weight percent dimethyl carbonate and from about 99.9 to about 88 weight percent methoxy perfluoroheptene.

26. The composition of any one of embodiments 1, 20, 21, and 24, wherein the composition consists essentially of about 8 weight percent dimethyl carbonate and about 92 weight percent methoxy perfluoroheptene.

27. The composition of any one of embodiments 20 to 26, wherein the composition is an azeotrope composition.

28. The composition any one of embodiments 1 and 20 to 27, wherein the composition has a boiling point of about 74° C. at a pressure of about 101 kPa.

29. In some embodiments, the present application provides a composition comprising HFC-4310mee and methyl acetate, wherein HFC-4310mee and methyl acetate are present in the composition in amounts effective to form an azeotrope composition or azeotrope-like composition.

30. The composition of embodiment 29, wherein the composition comprises about 15 to about 30 weight percent methyl acetate.

31. The composition of embodiment 29 or 30, wherein the composition comprises about 70 to about 85 weight percent HFC-4310mee.

32. The composition of embodiment 29, wherein the composition consists essentially of HFC-4310mee and methyl acetate.

33. The composition of embodiment 29 or 32, wherein the composition consists essentially of about 15 to about 30 weight percent methyl acetate and about 70 to about 85 weight percent HFC-4310mee.

34. The composition of any one of embodiments 29, 32, and 33, wherein the composition consists essentially of about 25 weight percent methyl acetate and about 75 weight percent HFC-4310mee.

35. The composition of any one of embodiments 29 to 34, wherein the composition is an azeotrope composition.

36. The composition of any one of embodiments 29 to 35, wherein the composition has a boiling of about 59° C. to about 60° C. at a pressure of about 101 kPa.

37. In some embodiments, the present application further provides a process for dissolving a solute, comprising contacting and mixing said solute with a sufficient quantity of the composition of any one of embodiments 1 to 36.

38. In some embodiments, the present application further provides a process of cleaning a surface, comprising contacting the composition of any one of embodiments 1 to 36 with said surface.

39. In some embodiments, the present application further provides a process for removing at least a portion of water from the surface of a wetted substrate, comprising contacting the substrate with the composition of any one of embodiments 1 to 36, and then removing the substrate from contact with the composition.

40. The process of embodiment 39, wherein composition further comprises at least one surfactant suitable for dewatering or drying the substrate.

It is to be understood that while the invention has been described in conjunction with the detailed description thereof, the foregoing description is intended to illustrate and not limit the scope of the invention, which is defined by the scope of the appended claims. Other aspects, advantages, and modifications are within the scope of the following claims. It should be appreciated by those persons having ordinary skill in the art(s) to which the present invention relates that any of the features described herein in respect of any particular aspect and/or embodiment of the present invention can be combined with one or more of any of the other features of any other aspects and/or embodiments of the present invention described herein, with modifications as appropriate to ensure compatibility of the combinations. Such combinations are considered to be part of the present invention contemplated by this disclosure.

What is claimed is:

1. A composition, comprising:

i) dimethyl carbonate; and ii) a compound selected from methoxy perfluoroheptene and methoxy perfluoropentene;

wherein the methoxy perfluoroheptene or methoxy perfluoropentene is present in the composition in an amount effective to form an azeotrope composition or azeotrope-like composition with the dimethyl carbonate.

2. The composition of claim 1, wherein the composition comprises dimethyl carbonate and methoxy perfluoroheptene, wherein the methoxy perfluoroheptene is present in the composition in an amount effective to form an azeotrope composition or azeotrope-like composition with the dimethyl carbonate.

3. The composition of claim 2, wherein the methoxy perfluoroheptene comprises a mixture of (E)-4-methoxy-perfluorohept-3-ene, (E)-3-methoxy-perfluorohept-3-ene, (E)-5-methoxy-perfluorohept-3-ene, (E)-4-methoxy-perfluorohept-2-ene, (Z)-3-methoxy-perfluorohept-3-ene, and (Z)-4-methoxy-perfluorohept-3-ene.

4. The composition of claim 3, wherein the composition comprises from about 80 to about 40 weight percent dimethyl carbonate and from about 20 to about 60 weight percent methoxy perfluoroheptene.

5. The composition of claim 3, wherein the composition consists essentially of from about from about 80 to about 40 weight percent dimethyl carbonate and from about 20 to about 60 weight percent methoxy perfluoroheptene.

6. The composition of claim 3, wherein the composition consists essentially of about 50 weight percent dimethyl carbonate and about 50 weight percent methoxy perfluoroheptene.

7. The composition of claim 6, wherein the composition is an azeotrope composition having a boiling point of about 85° C. to about 86° C. at a pressure of about 101 kPa.

8. The composition of claim 3, further comprising 1,1,2,2,3,3,4-heptafluorocyclopentane, wherein the methoxy perfluoroheptene and 1,1,2,2,3,3,4-heptafluorocyclopentane are each present in the composition in amounts effective to form an azeotrope composition or azeotrope-like composition with the dimethyl carbonate.

9. The composition of claim 8, wherein the composition comprises from about 22 to about 35 weight percent dimethyl carbonate, from about 22 to about 35 weight percent methoxy perfluoroheptene and from about 30 to about 52 weight percent 1,1,2,2,3,3,4-heptafluorocyclopentane.

10. The composition of claim 8, wherein the composition consists essentially of dimethyl carbonate, methoxy perfluoroheptene, and from about 30 to about 52 weight percent methoxy perfluoroheptene.

11. The composition of claim 8, wherein the composition consists essentially of from about 22 to about 35 weight percent dimethyl carbonate, from about 22 to about 35 weight percent methoxy perfluoroheptene, and from about 30 to about 52 weight percent 1,1,2,2,3,3,4-heptafluorocyclopentane.

12. The composition of claim 8, wherein the composition consists essentially of about 40 weight percent 1,1,2,2,3,3,4-heptafluorocyclopentane, about 30 weight percent dimethyl carbonate, and about 30 weight percent methoxy perfluoroheptene.

13. The composition of claim 12, wherein the composition is an azeotrope composition having a boiling point of about 88° C. at a pressure of about 101 kPa.

14. The composition of claim 1, wherein the composition comprises dimethyl carbonate and methoxy perfluoropentene, wherein the methoxy perfluoropentene is present in the composition in an amount effective to form an azeotrope composition or azeotrope-like composition with the dimethyl carbonate.

15. The composition of claim 14, wherein the methoxy perfluoropentene comprises a mixture of (E)-2-methoxy-perfluoropent-2-ene, (E)-4-methoxy-perfluoropent-2-ene, (Z)-2-methoxy-perfluoropent-2-ene, (Z)-4-methoxy-perfluoropent-2-ene, (E)-3-methoxy-perfluoropent-2-ene, and (Z)-3-methoxy-perfluoropent-2-ene.

16. The composition of claim 14, wherein the composition comprises from about 0.1 to about 12 weight percent dimethyl carbonate and from about 99.9 to about 88 weight percent methoxy perfluoropentene.

17. The composition of claim 14, wherein the composition consists essentially of from about from about 0.1 to about 12 weight percent dimethyl carbonate and from about 99.9 to about 88 weight percent methoxy perfluoropentene.

18. The composition of claim 14, wherein the composition consists essentially of about 8 weight percent dimethyl carbonate and about 92 weight percent methoxy perfluoropentene.

19. The composition of claim 14, wherein the composition is an azeotrope composition having a boiling point of about 74° C. at a pressure of about 101 kPa.

20. A process for dissolving a solute, comprising contacting and mixing said solute with a sufficient quantity of the composition of claim 1.

21. A process of cleaning a surface, comprising contacting the composition claim 1 with said surface.

22. A process for removing at least a portion of water from the surface of a wetted substrate, comprising contacting the substrate with the composition of claim 1, and then removing the substrate from contact with the composition.

23. The process of claim 22, wherein composition further comprises at least one surfactant suitable for dewatering or drying the substrate.

* * * * *